US006477868B2

(12) United States Patent
Chang

(10) Patent No.: US 6,477,868 B2
(45) Date of Patent: Nov. 12, 2002

(54) WASHING MACHINE WITH BALANCER

(75) Inventor: Jae Won Chang, Kyungki-do (KR)

(73) Assignee: LG Electronics Inc., Seoul (KR)

( * ) Notice: Subject to any disclaimer, the term of this patent is extended or adjusted under 35 U.S.C. 154(b) by 71 days.

(21) Appl. No.: 09/749,641

(22) Filed: Dec. 28, 2000

(65) Prior Publication Data

US 2001/0020376 A1 Sep. 13, 2001

(30) Foreign Application Priority Data

Mar. 11, 2000 (KR) ..... 2000-12306

(51) Int. Cl.[7] ..... D06F 37/22
(52) U.S. Cl. ..... 68/23.2
(58) Field of Search ..... 68/23.2, 12.02, 68/12.06, 12.14; 210/144; 74/573 F

(56) References Cited

U.S. PATENT DOCUMENTS 3,214,946 A * 11/1965 Starr et al. ..... 68/23.2
4,991,247 A * 2/1991 Castwall et al. ..... 68/23.2 X
5,582,040 A * 12/1996 Khan ..... 68/23.2

* cited by examiner

*Primary Examiner*—Philip R. Coe
(74) *Attorney, Agent, or Firm*—Fleshner & Kim, LLP

(57) ABSTRACT

A washing machine with a balancer is provided which is capable of improving the balancing capacity of the balancer with respect to conventional devices, preventing the balancer from being damaged due to thermal expansion, and simplifying the manufacture and assembly of the balancer. The washing machine includes an outer tab for accommodating washing water. An inner tub is rotatably mounted in the outer tab for washing and spin-drying the laundry. A balancer is mounted to the inner tub to be opened at one side. The balancer accommodates water to balance the inner tub. Water supply means supplies washing water to the balancer. A cabinet encloses the components of the washing machine.

20 Claims, 4 Drawing Sheets

WASHING MACHINE WITH BALANCER

BACKGROUND OF THE INVENTION

1. Field of the Invention

The present invention relates generally to a washing machine with a balancer, and more particularly to a washing machine, which is equipped with a balancer on a portion of the inner tub of the washing machine having a horizontally disposed drive shaft, thereby reducing its vibration and noise during a spin-drying process.

2. Description of the Prior Art

As shown in FIG. 1, a conventional washing machine includes a cabinet 1. A door 3 is openably mounted to the front of the cabinet 1 to allow the laundry to be fed and discharged. An outer tub 5 is situated in the cabinet 1 to accommodate water.

An inner tub 7 provided with a plurality of water passage holes 7*a* is rotatably positioned in the outer tub 5. A lifter 9 is mounted on the bottom of the interior of the inner tub 7 to raise the washing water to a predetermined height and, thereafter, allow it to fall down due to gravitational force. A water supply hose 13 passes through the cabinet 1, and a water supply valve 11 is positioned on the water supply hose 13, so as to supply water necessary for washing. A detergent container 15 is formed in the upper portion of the cabinet 1 to supply a detergent. A water supply bellows 17 is situated between the detergent container 15 and the outer tub 5 to supply to the outer tub 5 water that has been supplied through the water supply hose 13 and has been mixed with the detergent.

A motor 19 is mounted beneath the outer tub 5. A belt 21 and a pulley 23 are situated in the vicinity of the motor 19 to rotate the inner tub 7 normally and reversely.

A water drain bellows 25 is situated under the outer tub 5 to drain water that is used in the washing machine. A drain pump 27 is mounted to the end portion of the drain bellows 25 to pump water that is drained through the water drain bellows 25. A drain hose 29 is connected to the drain pump 27 to drain to the outside water pumped by the drain pump 27.

A water level sensor 31 is positioned in the cabinet 1 so as to sense a water level by means of water pressure to determine if water is supplied to the outer tub 5 or not. A gasket 35 is interposed between the door 3 and the outer tub 5 to prevent water contained in the outer tub 5 from leaking.

Reference numerals 37, 39 and 25*a* designate a spring for supporting the upper portion of the outer tub 5, a damper for supporting the lower portion of the outer tub 5 and reducing the vibrations of the outer tub 5, and a drain valve, respectively.

However, in the conventional drum washing machine, there occurs a shortcoming in which the inner tub 7 is imbalanced due to the maldistribution of the laundry when the inner tub 7 is rotated at a high speed to spin-dry the laundry, thereby generating vibration and noise.

In the meantime, in the conventional vertical washing machine (in which a drive shaft is positioned perpendicular to the ground), there occur shortcomings in which the balancing force of the balancer cannot be adjusted due to its balancer being hermetically sealed, its balancer may be damaged due to its thermal expansion during the heating of washing water and, the manufacture and assembly of its balancer is difficult.

SUMMARY OF THE INVENTION

Accordingly, the present invention has been made keeping in mind the above problems occurring in the prior art, and an object of the present invention is to provide a washing machine with a balancer, which is capable of improving the balancing capacity of its balancer to reduce vibration and noise, of preventing the balancer from being damaged due to thermal expansion to increase the durability of the balancer, and of simplifying the manufacture and assembly of the balancer to reduce the manufacturing cost of the washing machine.

In order to accomplish the above object, the present invention provides a washing machine, comprising an outer tub for accommodating washing water, an inner tub rotatably mounted in the outer tub for washing and spin-drying the laundry, a balancer mounted to the inner tub to be opened at its one side, the balancer accommodating water to balance the inner tub, water supply means for supplying washing water to the balancer, and a cabinet for constituting the boundary of the washing machine and enclosing the components of the washing machine.

BRIEF DESCRIPTION OF THE DRAWINGS

The above and other objects, features and other advantages of the present invention will be more clearly understood from the following detailed description taken in conjunction with the accompanying drawings, in which.

DESCRIPTION OF THE PREFERRED EMBODIMENTS

Figure 1:
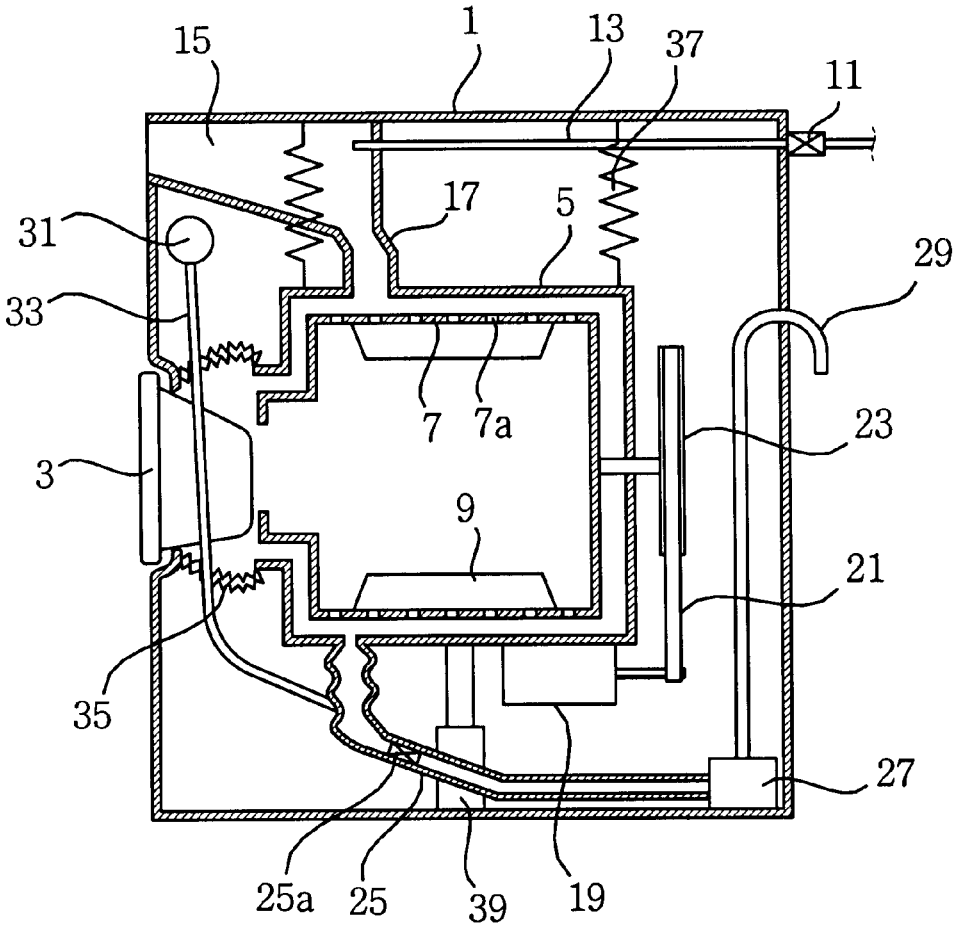
FIG.1(Prior Art)
FIG. 1 is a vertical cross section of a conventional washing machine.

Reference now should be made to the drawings, in which the same reference numerals are used throughout the different drawings to designate the same or similar components.

With reference to FIGS. 2 to 6, there is described a preferred embodiment of the present invention.

Figure 2:
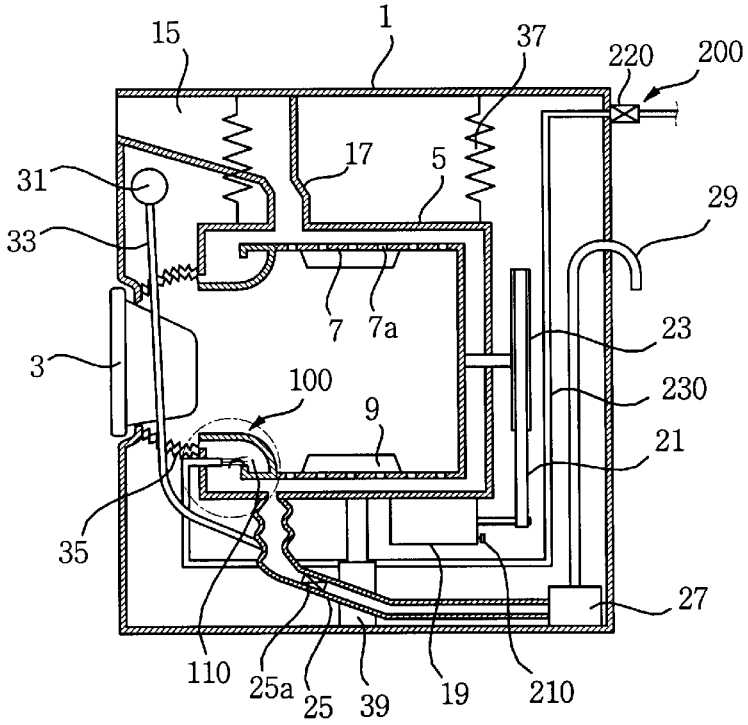
FIG. 2 is a vertical cross section of a washing machine in accordance with the preferred embodiment of the present invention.
Figure 3:
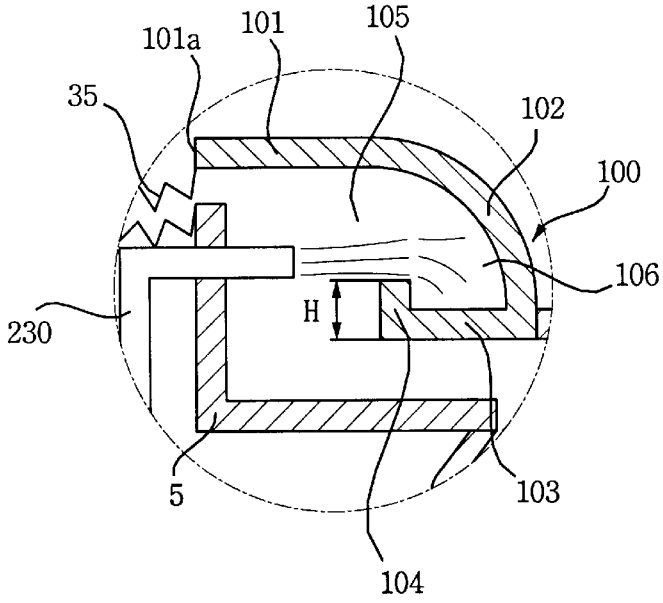
FIG. 3 is enlarged view of "A" portion of FIG. 2.
Figure 4:
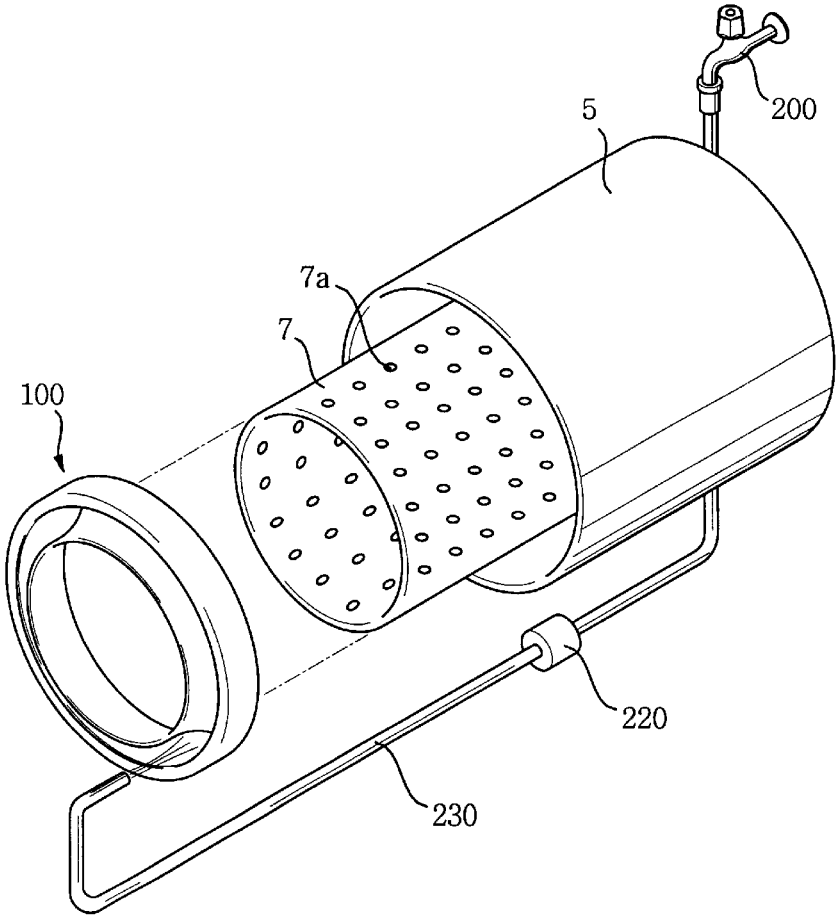
FIG. 4 is an enlarged, exploded perspective view showing the principal components of the washing machine.
Figure 5:
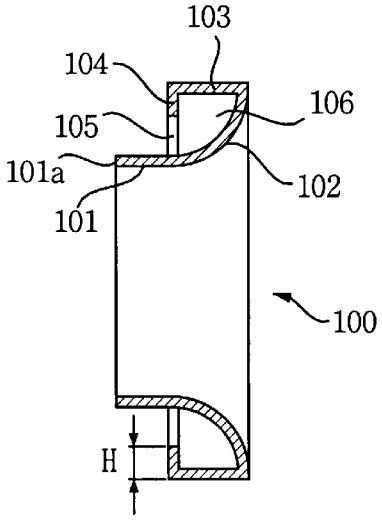
FIG. 5 is a cross section of a balancer in accordance with the preferred embodiment of the present invention.
Figure 6:
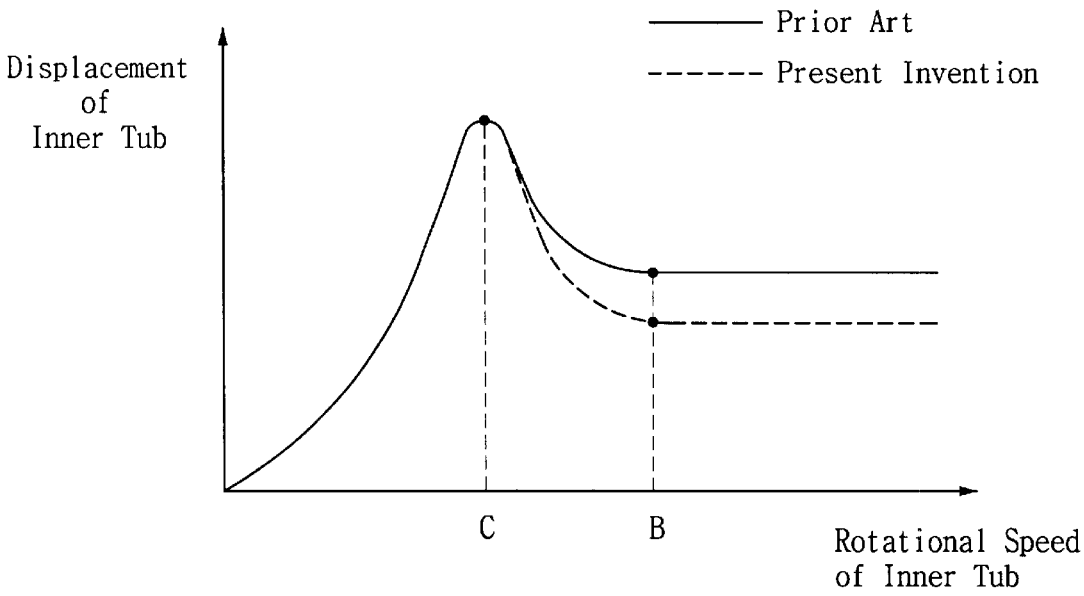
FIG. 6 is a graph in which the displacements of an inner tub are plotted with regard to the rotational speeds of an inner tub.

FIG. 2 is a vertical cross section of a washing machine in accordance with the preferred embodiment of the present invention. FIG. 3 is enlarged view of "A" portion of FIG. 2. FIG. 4 is an enlarged, exploded perspective view showing the principal components of the washing machine. FIG. 5 is a cross section of a balancer in accordance with the preferred embodiment of the present invention. FIG. 6 is a graph in which the displacements of an inner tub are plotted with regard to the rotational speeds of an inner tub.

As shown in FIG. 2, the washing machine of the present invention includes a cabinet 1 that constitutes the boundary of the washing machine. A door 3 is openably mounted to the front of the cabinet 1 to allow the laundry to be fed and discharged. An outer tub 5 is situated in the cabinet 1 to accommodate washing water. An inner tub 7 provided with a plurality of water passage holes 7*a* is rotatably positioned in the outer tub 5. A lifter 9 is mounted on the bottom of the interior of the inner tub 7. A water supply means is mounted to the interior of the cabinet 1 to supply washing water to the washing machine. A motor 19 is attached beneath the outer tub 5. A belt 21 and a pulley 23 are situated in the vicinity of the motor 19 to rotate the inner tub 7 normally and reversely.

A balancer 100 is mounted to the front end of the inner tub 7 to balance the inner tub 7 during high-speed rotation for a spin-drying process, thereby reducing vibration and noise. The balancer 100 may be attached to the front end of the inner tub 7 in a tight-fitting or welding fashion, or may be integrally formed with the inner tub 7.

The balancer 100 comprises a cylindrical portion 101 extended horizontally, a bell portion 102 expanded downwardly rearward from the rear end of the cylindrical portion 101, a skirt portion 103 extended from the rear end of the bell portion 102 to the rear end of the cylindrical portion 101, and a bent portion 104 extended radially inward from the front end of the skirt portion 103 to be spaced apart from the cylindrical portion 101 and form an opening 105 between the cylindrical portion 101 and itself. Accordingly, a space is formed between the bell portion 102, the skirt portion 103 and the bent portion 104 to accommodate water, and the cylindrical portion 101 is projected forward past the bent portion 104.

As a result, as the balancer 100 is rotated, water having being supplied to the space 106 through the opening 105 is moved through the skirt portion 103 and fills the entire space 106, due to centrifugal force.

A speed sensor 210 is mounted to a portion of the motor 19 to sense that the rotational speed of the inner tub 7 passes through a critical speed (see "C" in FIG. 6) of the inner tub 7 and reaches a speed (see "B" in FIG. 6) at which the centrifugal force exceeds gravitational force. The water supply means is comprised of a water supply source 200, a water supply hose 230 for supplying water from the water supply source 200 to the space 106 of the balancer 100 through the opening 105 of the balancer 100, and a water supply valve 220 mounted on the water supply hose 230 for selectively being opened and closed in response to a signal from the speed sensor 210.

The critical speed denotes a speed in which the amplitude of vibration is infinitely enlarged due to the coincidence of the natural frequency of the inner tub and the rotational speed of a drive shaft during the rotation of the drive shaft along with the inner tub 7.

Next there is described the operation of the washing machine with a balancer.

When a user starts the washing machine by manipulating a control panel (not shown) after opening the door 7, feeding the laundry into the inner tub 7 and shutting the door 7, the water supply valve 220 is turned ON, and water is initially supplied through the water supply hose 230 and sent to the space 106 of the balancer 100 through the opening 105 of the balancer 100. At this time, water having filled the space of the balancer 100 overflows through the opening 105 of the balancer 100 into the outer tub 5, and thereafter water having overflowed into the outer tub 5 passes through the water passage holes 7*a* and fills the inner tub 7.

When water fills the outer and inner tubs 5 and 7 to a predetermined height, the water pressure of the interior of the outer tub 5 is transmitted to the water level sensor 31 through the drain bellows 25 and a water level sensor hose 33. As a result, the water supply valve 220 is turned OFF, thereby stopping a water supply process.

When the water supply is stopped, washing and rinsing processes are performed while the motor 19 is operated and the inner tub 7 is normally and reversely rotated by means of the belt 21 and the pulley 23.

At this time, the laundry is raised up to a predetermined height by means of the lifter 9 and lowered down from the height by means of gravitational force, so that the laundry is washed through a mechanical operation.

After the washing and rinsing processes are performed, the drain valve 25*a* is opened, washing water is drained through the drain bellows 25, and the washing water having passed through the drain bellows 25 is pumped by the drain pump 27 and drained to the outside through the drain hose 29.

Meanwhile, after the washing and rinsing processes are performed, the motor 19 is rotated in a predetermined direction to spin-dry the laundry and the inner tub 7 is also rotated in the direction, so that the laundry is spin-dried by means of centrifugal force. Water removed from the laundry is drained to the outside through the water passage holes 7*a* of the inner tub 7, the outer tub 5, the drain bellows 25, the drain pump 27 and the drain hose 29.

When the speed sensor 210 mounted to a portion of the motor 19 senses that the rotational speed of the inner tub 7 passes through the critical speed of the inner tub 7 and reaches a speed at which the centrifugal force exceeds gravitational force, the water supply valve 220 is opened and water is supplied from the water supply source 200 through the water supply hose 230. Water having been supplied through the water supply hose 230 is supplied to the space 106 through the opening 105 of the balancer 100.

The water having entered the space 106 balances the inner tub 7 tending to lean while being brought into tight contact with and flowing along the inner surface of the skirt portion 103 of the balancer 100 by means of centrifugal force, thereby reducing vibration and noise.

The balancing capacity of the balancer 100 depends upon the amount of water supplied to the space 106 and the height H of the bent portion 104.

In the meantime, in the case of utilizing boiled water, the balancer 100 is not damaged due to thermal expansion because the balancer 100 can absorb the effect of the thermal expansion due to the presence of the opening 105.

Although the speed sensor 210 is described as being mounted to a portion of the motor 19, the position of the speed sensor 210 is not limited to that position, but the speed sensor 210 may be mounted to a portion of the inner tub 7 to sense the rotational speed of the inner tub 7.

In addition, although water is described as being supplied through the space 106 of the balancer 100, the washing water can be supplied in other ways. That is, during washing and rinsing processes water may be supplied through a portion of the outer tub 5 as in a conventional art, while during a spin-drying process water may be supplied to the interior of the balancer 100.

FIG. 6 is a graph in which the maximum displacements of the inner tub 7 with and without the balancer 100 are plotted with regard to the rotational speeds of the inner tub 7. In the graph, an "X" axis represents the rotational speeds of the inner tub 7 during a spin-drying process, while a "Y" axis represents the maximum displacements of the inner tub 7. The speed "B" denotes a speed that the inner tub 7 reaches after passing through the critical speed C and at which centrifugal force exceeds gravitational force.

In the graph, a dotted line represents the displacements of the inner tub 7 without the balancer 100 with regard to the maximum rotational speed of the inner tub 7 without the balancer 100, while a solid line represents the displacements of the inner tub 7 with the balancer 100 with regard to the maximum rotational speed of the inner tub 7 with the balancer 100. As apparent from the graph, in a case where the balancer 100 is mounted to the inner tub 7 the displacements of the inner tub 7 can be reduced.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A washing machine, comprising:

a cabinet;

an outer tub for accommodating washing water contained within the cabinet;

an inner tub rotatably mounted in said outer tub for washing and spin-drying laundry;

a balancer mounted to the inner tub on a front portion of the inner tub with respect to a door of the washing machine and opened one side, said balancer accommodating water to balance said inner tub; and water supply means for supplying washing water to said balancer.

2. The washing machine according to claim 1, wherein said washing machine is a drum washing machine in which said outer and inner tubs are horizontally arranged, and said balancer is attached to a front end of the inner tub.

3. The washing machine according to claim 2, wherein said water supply means comprises a water supply source, a water supply hose for supplying water from said water supply source to said balancer, and a water supply valve mounted to said water supply hose.

4. The washing machine according to claim 3, further comprising a speed sensor for sensing the rotational speed of said inner tub, said speed sensor opening said water supply valve and allowing water to be supplied to said balancer when the rotational speed of the inner tub is greater than a predetermined speed.

5. The washing machine according to claim 3 or 4, wherein said water supply valve is opened to supply water to said balancer when the centrifugal force generated by the rotation of said inner tub exceeds gravitational force.

6. A washing machine comprising:

a cabinet;

an outer tub for accommodating washing water contained within the cabinet;

an inner tub rotatably mounted in the outer tub for washing and spin-drying laundry;

a balancer mounted to the inner tub and opened at one side, said balancer accommodating water to balance said inner tub; and water supply means for supplying washing water to said balancer, wherein said balancer comprises a cylindrical portion extended horizontally, a bell portion expanded downwardly rearward from a rear end of the cylindrical portion, a skirt portion extended from a rear end of the bell portion to the rear end of the cylindrical portion, and a bent portion extended radially inward from a front end of the skirt portion to be spaced apart from the cylindrical portion and to form an opening between the cylindrical portion and the bent portion.

7. The washing machine according to claim 6, wherein said expanded portion is in the form of a bell that gradually expands rearwardly.

8. The washing machine according to claim 6, wherein a front end of said the cylindrical portion is projected forward past the bent portion.

9. The washing machine according to claim 1, wherein the balancer comprises a cylinder having a bell portion that gradually expands rearwardly and extends into the inner tub into which washing water is directed by the water supply means, a skirt portion that extends from an end of the bell portion toward a front portion of the washing machine and a bent portion that extends radially inward from a front portion of the skirt portion.

10. The washing machine according to claim 6, wherein said washing machine is a drum washing machine in which said outer and inner tubs are horizontally arranged, and said balancer is attached to a front end of the inner tub.

11. The washing machine according to claim 10, wherein said water supply means comprises a water supply source, a water supply hose for supplying water from said water supply source to said balancer, and a water supply valve mounted to said water supply hose.

12. A washing machine, comprising:

a cabinet;

an outer tub for accommodating washing water contained within the cabinet;

an inner tub rotatably mounted in said outer tub for washing and spin-drying laundry;

a balancer mounted to the inner tub on a front portion of the inner tub with respect to a door of the washing machine and opened at one side, said balancer accommodating water to balance said inner tub;

water supply means for supplying washing water to said balancer, wherein said water supply means comprises a water supply source, a water supply hose for supplying water from said water supply source to said balancer, and a water supply valve mounted to said water supply hose; and a speed sensor for sensing the rotational speed of said inner tub, said speed sensor opening said water supply valve and allowing water to be supplied to said balancer when the rotational speed of the inner tub is greater than a predetermined speed.

13. A washing machine comprising:

a cabinet;

an outer tub for accommodating washing water contained within the cabinet;

an inner tub rotatably mounted in said outer tub for washing and spin-drying laundry;

a balancer mounted to the inner tub on a front portion of the inner tub with respect to a door of the washing machine and opened at one side, said balancer accommodating water to balance said inner tub; and water supply means for supplying washing water to said balancer, wherein said water supply means comprises a water supply source, a water supply hose for supplying water from said water supply source to said balancer, and a water supply valve mounted to said water supply hose, and wherein said water supply valve is opened to supply water to said balancer when the centrifugal force generated by the rotation of said inner tub exceeds gravitational force.

14. A washing machine, comprising:

a cabinet;

an outer tub for accommodating washing water contained within the cabinet;

an inner tub rotatably mounted in said outer tub for washing and spin-drying laundry;

a balancer mounted to the inner tub and opened at one side, said balancer accommodating water to balance said inner tub and comprising a cylinder having a bell portion that extends into the inner tub; and water supply means for supplying washing water to said balancer.

15. The washing machine according to claim 14, wherein said washing machine is a drum washing machine in which said outer and inner tubs are horizontally arranged, and said balancer is attached to a front end of the inner tub.

16. The washing machine according to claim 15, wherein said water supply means comprises a water supply source, a water supply hose for supplying water from said water supply source to said balancer, and a water supply valve mounted to said water supply hose.

17. The washing machine according to claim 16, further comprising a speed sensor for sensing the rotational speed of said inner tub, said speed sensor opening said water supply valve and allowing water to be supplied to said balancer when the rotational speed of the inner tub is greater than a predetermined speed.

18. The washing machine according to claim 16, wherein said water supply valve is opened to supply water to said balancer when the centrifugal force generated by the rotation of said inner tub exceeds gravitational force.

19. The washing machine according to claim 14, wherein the bell portion gradually expands rearwardly.

20. The washing machine according to claim 14, wherein the balancer further comprises a skirt portion that extends from an end of the bell portion toward a front portion of the washing machine, and a bent portion that extends radially inward from a front portion of the skirt portion.

* * * * *